US009204510B2

(12) United States Patent
Morales

(10) Patent No.: US 9,204,510 B2
(45) Date of Patent: Dec. 1, 2015

(54) CURRENT STEERING MODULE FOR USE WITH LED STRINGS

(71) Applicant: iSine, Inc., Ronkonkoma, NY (US)

(72) Inventor: Louis J. Morales, Somerville, MA (US)

(73) Assignee: iSine, Inc., Ronkonkoma, NY (US)

( * ) Notice: Subject to any disclaimer, the term of this patent is extended or adjusted under 35 U.S.C. 154(b) by 0 days.

(21) Appl. No.: 14/293,616

(22) Filed: Jun. 2, 2014

(65) Prior Publication Data

US 2014/0354157 A1 Dec. 4, 2014

Related U.S. Application Data

(60) Provisional application No. 61/829,726, filed on May 31, 2013.

(51) Int. Cl.
*H05B 33/08* (2006.01)

(52) U.S. Cl.
CPC ..... *H05B 33/083* (2013.01); *H05B 33/0815* (2013.01)

(58) Field of Classification Search
CPC ... H05B 33/083; H05B 37/02; H05B 33/0821
USPC ..... 315/122, 185 R, 294, 297
See application file for complete search history.

(56) References Cited

U.S. PATENT DOCUMENTS

2012/0038285 A1* 2/2012 Leung et al. ..... 315/193
2013/0069536 A1* 3/2013 Ni ..... 315/122
2014/0339984 A1* 11/2014 Leung et al. ..... 315/122

* cited by examiner

*Primary Examiner* — Don Le
(74) *Attorney, Agent, or Firm* — Sterne, Kessler, Goldstein & Fox P.L.L.C.

(57) ABSTRACT

In an embodiment, a lamp control circuit is provided. The lamp control circuit includes an intermediate current steering block configured to be coupled to a cathode of a first light-emitting device of a plurality of light-emitting devices and a final current steering block configured to be coupled to a cathode of a final light-emitting device of the plurality of light-emitting devices. The final current steering block is configured to disable the intermediate current steering block and conduct current when a voltage input to the plurality of light-emitting devices is sufficient to activate all of the plurality of light-emitting devices.

10 Claims, 9 Drawing Sheets

500

CURRENT STEERING MODULE FOR USE WITH LED STRINGS

CROSS-REFERENCE TO RELATED APPLICATIONS

This non-provisional application claims the benefit of U.S. Provisional Application 61/829,726, filed 31 May 2013, and entitled "Current Steering Module For Use With LED Strings," the entirety of which is hereby incorporated by reference.

FIELD

Embodiments described herein generally relate to electrical circuitry for delivering power to a load, and more particularly relate to delivering power to semiconductor-based lighting products.

BACKGROUND

Recently, there has been great interest in reducing the energy consumption of lighting sources, as well as in reducing the size and costs of the lighting sources while also increasing the lifetime of such products. Since it is well known that conventional incandescent light bulbs waste a significant amount of energy in the form of heat, alternatives to incandescent lighting are seen as a possible means of reducing energy consumption. Semiconductor-based lighting products are an alternative form of lighting.

A light-emitting diode (LED) is a well-known semiconductor device comprising a PN junction that emits light when forward-biased. Conventional control circuits for LED-based lighting products typically consist of two circuit portions. A first one of the two circuit portions is an AC-to-DC converter. In some instances these AC-to-DC converters include power factor correction circuitry. A second one of the two circuit portions is a current controller coupled to drive a plurality of LEDs in series, in parallel, or in both series and parallel, depending on the desired wattage, voltage, and/or light output. Conventional versions of these circuits require various nodes therein to operate at relatively high voltages, and further require the presence of capacitors having high capacitance values. There are a number of different types of capacitor components; however, the only practical type of capacitors for the requirements mentioned above are electrolytic capacitors.

Unfortunately, incorporating electrolytic capacitors into these circuits limits the reliability of LED-based lighting products generally. In particular, electrolytic capacitors tend to be the electrical component that is among the first to fail in an LED-based lighting product.

SUMMARY

Briefly, circuitry, suitable for delivering power to a semiconductor-based lighting product, drives an LED array with current directly derived from a rectified AC voltage. In an embodiment, a lamp control circuit is provided. The lamp control circuit includes an intermediate current steering block configured to be coupled to a cathode of a first LED of a plurality of LEDs and a final current steering block configured to be coupled to a cathode of a final LED of the plurality of LEDs. The final current steering block is configured to disable the intermediate current steering block and conduct current when a voltage input to the plurality of LEDs is sufficient to activate all of the plurality of LEDs. The present invention may be applied to other forms of semiconductor-based lighting, and is not limited to LED-based lighting.

These and other advantages and features will become readily apparent in view of the following detailed description of the invention. Note that the Summary and Abstract of the Disclosure sections may set forth one or more, but not all exemplary embodiments of the present invention as contemplated by the inventor.

BRIEF DESCRIPTION OF THE DRAWINGS/FIGURES

Embodiments of the invention are described with reference to the accompanying drawings. In the drawings, like reference numbers indicate identical or functionally similar elements. Additionally, the left most digit(s) of a reference number identifies the drawing in which the reference number first appears.

DETAILED DESCRIPTION

Figure 1:
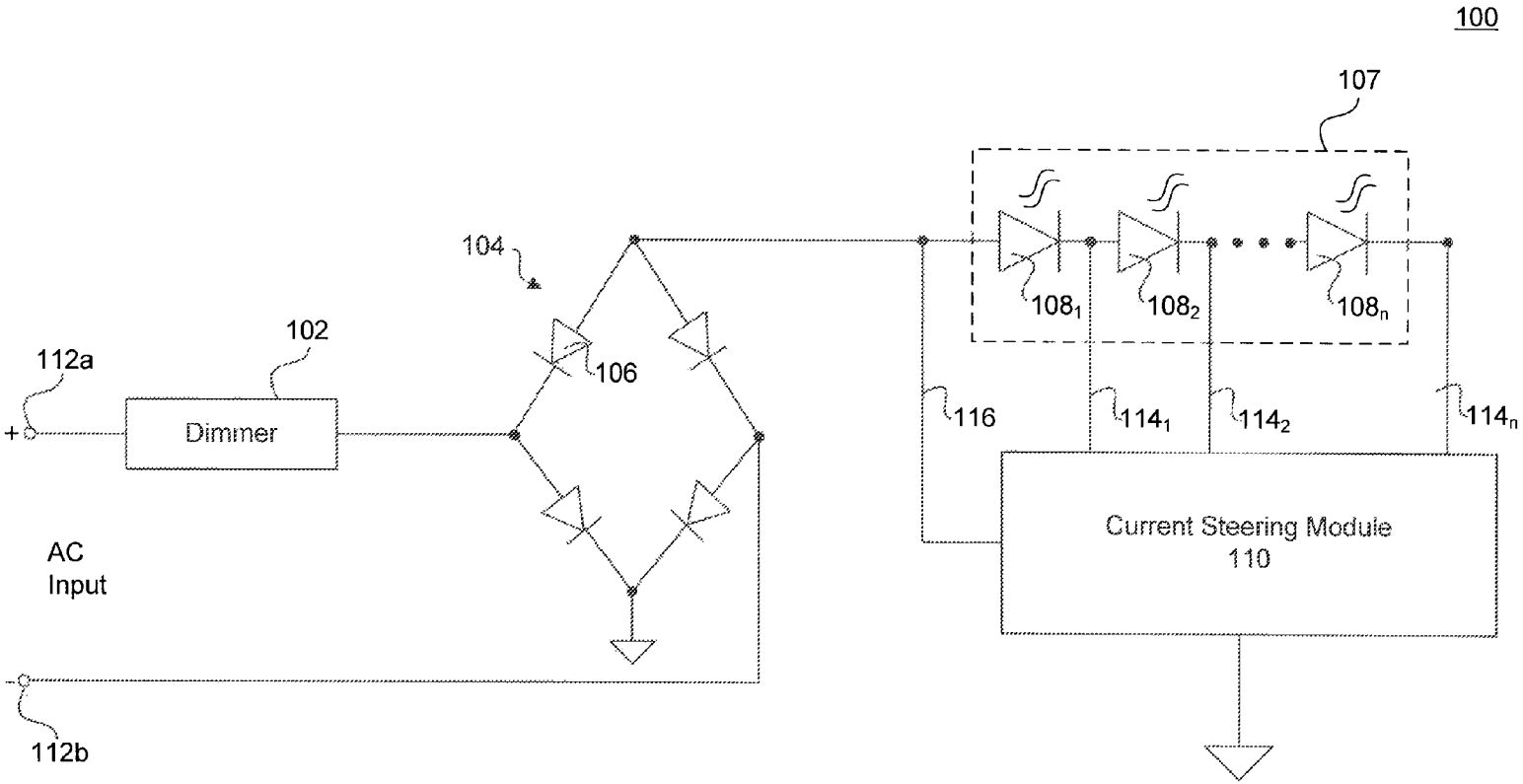
FIG. 1 is a schematic diagram of an exemplary light-emitting device.

The following Detailed Description refers to accompanying drawings to illustrate exemplary embodiments consistent with the invention. References in the Detailed Description to "one exemplary embodiment," "an illustrative embodiment," "an exemplary embodiment," and so on, indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s) to affect such feature, structure, or characteristic in connection with other exemplary embodiments whether or not explicitly described.

The exemplary embodiments described herein are provided for illustrative purposes, and are not limiting. Other embodiments are possible, and modifications may be made to the exemplary embodiments within the spirit and scope of the invention. Therefore, the Detailed Description is not meant to limit the invention. Rather, the scope of the invention is defined only in accordance with the subjoined claims and their equivalents.

The following Detailed Description of the exemplary embodiments will so fully reveal the general nature of the invention that others can, by applying knowledge of those skilled in relevant art(s), readily modify and/or adapt for various applications such exemplary embodiments, without undue experimentation, without departing from the spirit and scope of the invention. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

I. TERMINOLOGY

The expression "branch circuit" is generally understood to refer to a wire feed that goes from a branch circuit breaker to an electrical load.

Historically, power factor has referred to the ratio of the real power to the apparent power (a number between 0 and 1, and commonly expressed as a percentage). Real power is the capacity of a circuit to perform work in a particular time. Apparent power is the product of the current and voltage in the circuit, and consists of real power plus reactive power. Due to either energy stored in the load and returned to the source, or to a non-linear load that distorts the wave shape of the current drawn from the source, the apparent power can be greater than the real power. More recently, power factor has come to be defined as $$\frac{\cos\theta}{\sqrt{1+THD^2}}.$$

Where θ is the phase shift from real power, and THD is the total harmonic distortion. Low power factor loads increase losses in a power generation system and consequently increase energy costs.

Power factor correction refers to a technique of counteracting the undesirable effects of electric circuits that create a power factor that is less than one.

Figure 5:
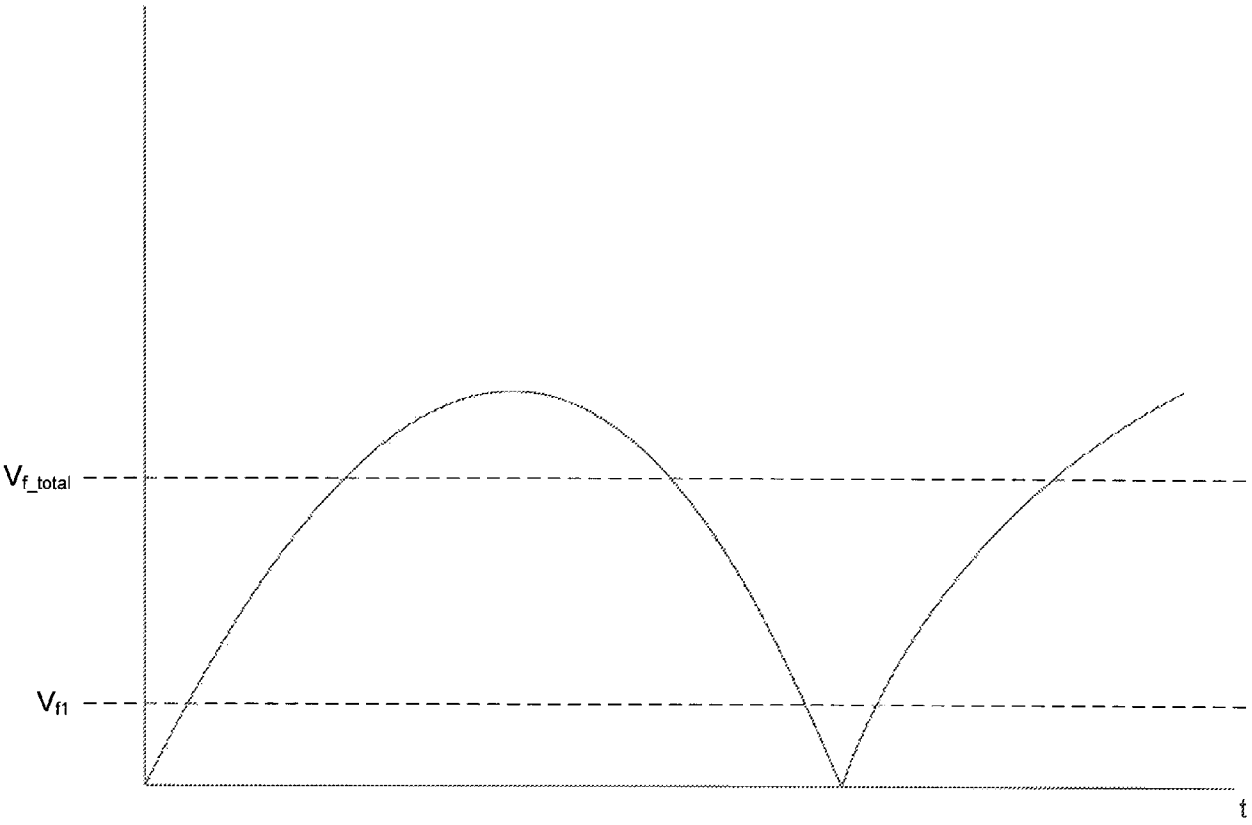
FIG. 5 is a plot of an exemplary full-wave rectified input voltage.

$V_f$ refers to the forward-bias voltage of an LED. As used herein, unless otherwise noted, $V_f$ is summed across an LED array in an LED-based lighting product. For example, as described in greater detail below, FIG. 5 shows a plot of an input voltage. As shown in FIG. 5, the forward voltage for a first LED in an LED string is $V_{f1}$ and the total forward voltage, i.e., the voltage required to turn on all of the LEDs in a string is $V_{ftotal}$.

Incandescence refers to emitting light as a result of heating.

Luminescence refers to cold body photon emission in response to stimuli including but not limited to electrical or chemical stimulation.

Fluorescence refers to photon emission at a first frequency in response to atomic or molecular absorption of a photon of a second frequency. As used herein, the second frequency is higher than the first frequency (e.g., an ultraviolet photon is absorbed by a phosphor, which in turn emits a visible light photon).

The term "lamp" refers generally to a man-made source created to produce optical radiation, which includes the visible spectrum. The term may also be used to denote sources that radiate in regions of the spectrum adjacent to the visible.

The term "luminaire" refers generally to a light fixture, and more particularly refers to a complete lighting unit consisting of lamp(s) and ballast(s) (when applicable) together with the parts designed to distribute the light, position and protect the lamps, and to connect the lamp(s) to the power supply.

The expression "LED luminaire" refers to a complete lighting unit that includes LED-based light-emitting elements (described below) and a matched driver together with parts to distribute light, to position and protect the light-emitting elements, and to connect the unit to a branch circuit or other overcurrent protector. The LED-based light-emitting elements may take the form of LED packages (components), LED arrays (modules), or LED lamps. An LED luminaire is typically connected directly to a branch circuit.

The expression "Solid State Lighting" (SSL) refers to the fact that the light is emitted from a solid object—a block of semiconductor—rather than from a vacuum or gas tube, as in the case of an incandescent and fluorescent light source. There are at least two types of solid-state light emitters, including inorganic light-emitting diodes (LEDs) or organic light-emitting diodes (OLEDs). Quantum dots (QDs) are also considered to be solid-state light emitters.

The expression "SSL Downlight Retrofit" refers to a type of solid state luminaire intended to install into an existing downlight, replacing the existing light source and related electrical components.

The term "triac" refers to a three-terminal electrical component that is operable to conduct current in a first direction and/or a second direction after it has been triggered, i.e., turned on. A triac may also be referred to as a bidirectional triode thyristor or as a bilateral triode thyristor. After a triac is turned on, it will continue to provide a conductive pathway until the magnitude of the current passing through the triac drops below a threshold amount. This threshold amount is referred to as the "holding current."

IGBT is an acronym for insulated-gate bipolar transistor. The IGBT is a three-terminal electrical device used in power switching applications.

FET is an acronym for field effect transistor. As used herein, FET refers to a metal-oxide-semiconductor field effect transistor (MOSFET). These transistors are also known as insulated gate field effect transistors (IGFETs). An n-channel FET is referred to as an NFET. A p-channel FET is referred to as a PFET. As used herein, the term FET is not intended to limit the invention to implementation by any particular semiconductor manufacturing product.

Source/drain terminals refer to the terminals of a FET, between which conduction occurs under the influence of an electric field, subsequent to the inversion of the semiconductor surface under the influence of an electric field resulting from a voltage applied to the gate terminal. Generally, the source and drain terminals of FETs used for logic applications are fabricated such that they are geometrically symmetrical. However, it is noted that the source and drain terminals of power FETs are often fabricated with asymmetrical geometries. With geometrically symmetrical source and drain terminals it is common to simply refer to these terminals as source/drain terminals, and this nomenclature is used herein. Designers often designate a particular source/drain terminal to be a "source" or a "drain" on the basis of the voltage to be applied to that terminal when the FET is operated in a circuit.

The term "nominal" as used herein refers to a desired, or target, value of a characteristic or parameter for a component or a signal, typically set during the design phase of a product, together with a range of values above and/or below the desired value. The range of values is typically due to slight variations in manufacturing processes or tolerances. By way of example and not limitation, a resistor may be specified as having a nominal value of 10 KΩ, which would be understood to mean 10 KΩ plus or minus a certain percentage (e.g., ±5%) of the specified value.

With respect to the various circuits, sub-circuits, and electrical circuit elements described herein, signals are coupled between them and other circuit elements via physical, electrically conductive connections. It is noted that, in this field, the point of connection is sometimes referred to as an input, output, input/output (I/O), terminal, line, pin, pad, port, interface, or similar variants and combinations.

Various embodiments of the present invention bypass the AC-to-DC conversion circuit found in conventional control circuitry for LED-based lighting products, and drive the LED array (series/parallel) with current directly derived from the rectified AC voltage.

In view of the respective principles of operation of incandescent light sources and semiconductor-based light sources, it will be appreciated that the mechanisms for controlling the dimming function in each type of light is different. Presented below is a description of the mechanisms for controlling dimming in each of the lighting types in view of their principles of operation. Further presented is a description of the principles, of receiving dimming control information from a conventional incandescent dimmer control circuit, and generating the necessary control signals to provide dimming functionality for semiconductor-based light sources.

Conventional incandescent light bulbs include a resistive filament (e.g., tungsten) disposed within an enclosed volume, the resistive filament being connected to electrical contacts disposed on an external surface of the incandescent light bulb (i.e., the conductive surfaces of the screwbase of the light bulb). Typical household incandescent lights are coupled to an AC power supply, and a current passes through the resistive filament within a bulb, thereby heating the filament so that it glows white hot, and produces light. It is noted that the resistive filament presents a linear load to the AC power supply, and therefore incandescent light bulbs do not present a concern with respect to power factor. Unfortunately, a significant portion of the power consumed by the incandescent light bulb is converted into heat rather than light.

Figure 9:
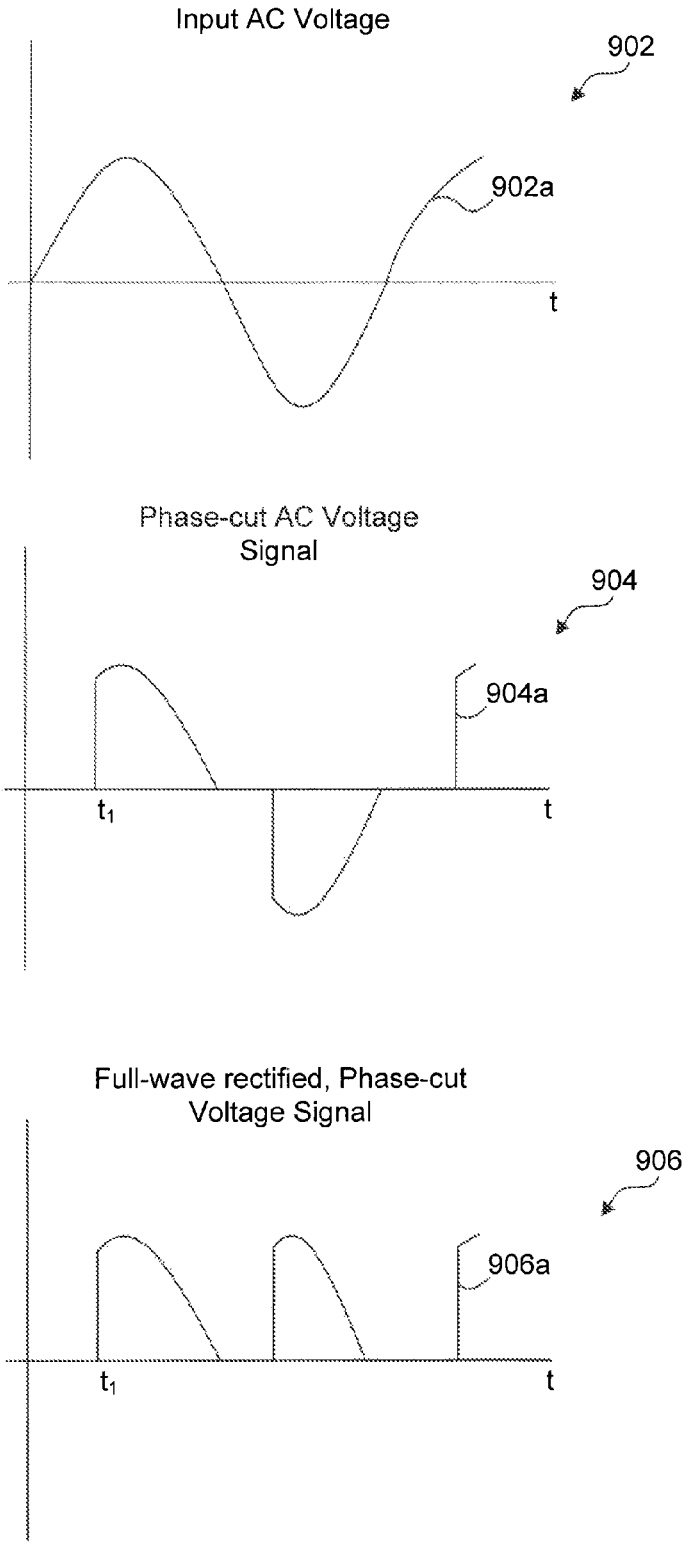
FIG. 9 shows plots an corresponding to an exemplary input voltage signal, an exemplary phase-cut voltage signal, and an exemplary full-wave rectified, phase-cut voltage signal.

Conventional methods of dimming an incandescent light involve chopping the AC voltage sine wave. This is sometimes referred to as phase cutting. By chopping out part of the AC power waveform, less energy is delivered to the filament of the incandescent bulb. An illustrative input voltage signal, phase-cut voltage signal, and a full-wave rectified, phase cut voltage signal can be seen in FIG. 9. FIG. 9 shows plots 902, 904, and 906 corresponding to an input AC voltage signal, a phase-cut AC voltage signal, and a full-wave rectified voltage signal, respectively. Plot 902 shows a waveform 902*a* that corresponds to an input AC voltage sine wave. Plot 904 shows a waveform 904*a* that is a phase-cut version of waveform 902*a*. Waveform 904*a* remains at 0V (i.e., the signal is "chopped") for the first $t_1$ of input voltage signal and then rises to the level of the input voltage signal. The proportion of time at 0V as opposed to the input voltage signal level can be determined based on the duty cycle of the control signal input to the dimmer. The embodiment of FIG. 9 shows an example of a "rising-edge" dimmer because the input voltage signal is chopped for the first $t_1$ of each period of the input voltage signal. In other embodiments, however, a "trailing-edge" dimmer can be used in which the last $t_1$ of each period of the input voltage signal is chopped. Plot 906 shows a waveform 906*a* that is a representation of a full-wave rectified version of waveform 904*a*. In particular, when waveform 904*a* is less than 0V, waveform 906*a* is equal in magnitude, but opposite in polarity to waveform 904*a*.

II. ILLUSTRATIVE EMBODIMENTS

FIG. 1 shows a schematic diagram of a lighting device 100, according to an embodiment. Device 100 includes a dimmer 102, a voltage rectifier 104, a string 107 of LEDs, and a current steering module 110. In the exemplary embodiment of FIG. 1, string 107 may be implemented as two or more LEDs 108 electrically connected in series. This embodiment of string 107, is not intended to be limiting. In alternative embodiments, LED string 107 may be implemented one LED 108.

As shown in FIG. 1, device 100 receives an alternative current (AC) input voltage at terminals 112*a* and 112*b*. In the embodiment of FIG. 1, dimmer 102 receives the positive component of the input voltage. Dimmer 102 can be configured to control the voltage waveform presented to rectifier 104. For example, dimmer 102 can be configured to "phase cut" a received AC input voltage signal. In such an embodiment, dimmer 102 can receive a control signal (not shown in the embodiment of FIG. 1) which controls the duty cycle of dimmer 102. In such a manner, portions of the input AC voltage signal can be "cut off," i.e., held at or near 0V when it would otherwise be greater or less than 0V.

For example, dimmer 102 can be a triode for alternating current (TRIAC) dimmer. As would be appreciated by those skilled in the art based on the description here, a TRIAC is a three-terminal device that can be "triggered," i.e., made to conduct between two of its terminals, based on a positive or negative voltage applied to its third terminal. As will be described in greater detail below, TRIACs generally require a "holding current." This is a relatively small current (e.g., 50 mA) that maintains a TRIAC in the conducting state after it has been triggered. A "triggered" TRIAC will leave the conducting state if the holding current drops below a predetermined threshold value.

A TRIAC, however, is only one embodiment of dimmer 102. Other types of dimmers can be used for dimmer 102. For example, an insulated-gate bipolar transistor (IGBT) could instead be used. In such an embodiment, dimmer 102 is coupled across terminals 112*a* and 112*b*. Unlike a TRIAC, an IGBT can provide dimming without the need for a holding current.

Still referring to FIG. 1, rectifier 104 receives the AC input voltage signal from dimmer 102. As would be appreciated by those skilled in the art based on the description herein, through the use of diodes 106, rectifier 104 operates to limit the incoming AC signal to a single polarity. Rectifier 104 is a full wave rectifier, thus, in ideal operation, the output is equal to the input when the input voltage is greater than or equal to 0V, and the output signal is equal in magnitude, but opposite in polarity to the input voltage signal when the input signal is less than 0V. For example, as will be described in greater detail below, FIG. 5 shows an example waveform of a full-wave rectified output. In practice, however, the output of rectifier 104 matches the input when the input voltage is near 0V, with "near" being defined in relation to the voltage drops across diodes 106.

Light-emitting device string 107 receives the rectified voltage signal from rectifier 104. In an embodiment, light-emitting device string 107 can include a variety of different types of semiconductor light-emitting devices. For example, light-emitting device string 107 can include LEDs, organic LEDs (OLEDs), and/or quantum dots. In the embodiment shown in FIG. 1, light-emitting diode string 107 includes n LEDs $\mathbf{108}_1$-$\mathbf{108}_n$ (collectively "LEDs 108"). Those skilled in the art will appreciate, however, that FIG. 1 only provides an illustrative embodiment and light-emitting strings having other types of light-emitting devices can be used.

In an embodiment, each of LEDs 108 has an associated forward voltage to turn it "on," i.e., the voltage needed for the LED to conduct current and emit light. In a further embodiment, all of LEDs 108 have the same forward voltage. For example, the forward voltage for each of LEDs 108 can be approximately 10V. In such an embodiment, all of LEDS 108 are turned on when the rectified AC input voltage is greater than or equal to n×10 Volts.

As shown in FIG. 1, current steering module 110 is coupled to the output of rectifier 104 and further coupled to the cathode of each of LEDs 108. In an embodiment, current steering module 110 can be configured to enable current to pass through all of LEDs 108 that can be activated at the instantaneous value of the rectified voltage. As noted above, each of LEDs 108 has a respective forward voltage needed to turn it on. In an embodiment where LEDs 108 are connected in series between a voltage source and a ground, none of LEDs 108 pass current until the input voltage exceeds the sum of the individual forward voltages.

FIG. 5 shows a plot 500 illustrating a full-wave rectified output voltage of rectifier 104. As shown in FIG. 5, only a portion of the input signal is above the voltage needed to turn on all of LEDs 108 (that value is termed $V_{f_total}$, as the sum of all the forward voltages). Thus, when LEDs 108 are connected in series between a voltage source and ground, string 107 only emits light during a relatively short portion of the input AC voltage signal.

In an embodiment, current steering module 110 is configured to enable current to pass through ones of LEDs 108 that can be turned on at a given input voltage. For example, referring to FIG. 5, when the input voltage is greater than $V_{f1}$, e.g., the forward voltage of LED $\mathbf{108}_1$, current steering module 110 can enable current to pass through LED $\mathbf{108}_1$ and path $\mathbf{114}_1$, and thereby enable LED $\mathbf{108}_1$ to emit light. In doing so, current steering module 110 can automatically prevent current from flowing in paths $\mathbf{114}_2$-$\mathbf{114}_n$. As the rectified input voltage rises above the sum of the forward voltages of LEDs $\mathbf{108}_1$ and $\mathbf{108}_2$, current steering module allows current to flow through path $\mathbf{114}_2$ and automatically disables path $\mathbf{114}_1$.

In an embodiment, current steering module 110 can be implemented using a current source for each of paths $\mathbf{114}_1$-$\mathbf{114}_n$. In other embodiments, however, as described below, current steering module 110 can use a single current source.

As shown in FIG. 1, current steering module 110 also controls a path 116. In an embodiment, path 116 can be a "holding current path." For example, when dimmer 102 is a TRIAC-based circuit, path 116 can provide a holding current when the rectified AC input voltage is not sufficient to turn any of LEDs 108 on. Once the rectified AC input voltage is sufficient to turn on LED $\mathbf{108}_1$, current steering module 110 automatically prevents current from passing through path 116 and instead enables current to pass through path $\mathbf{114}_1$. Thus, current steering module 110 can be configured such that at least one current path is enabled in order to maintain the required TRIAC holding current.

Figure 2:
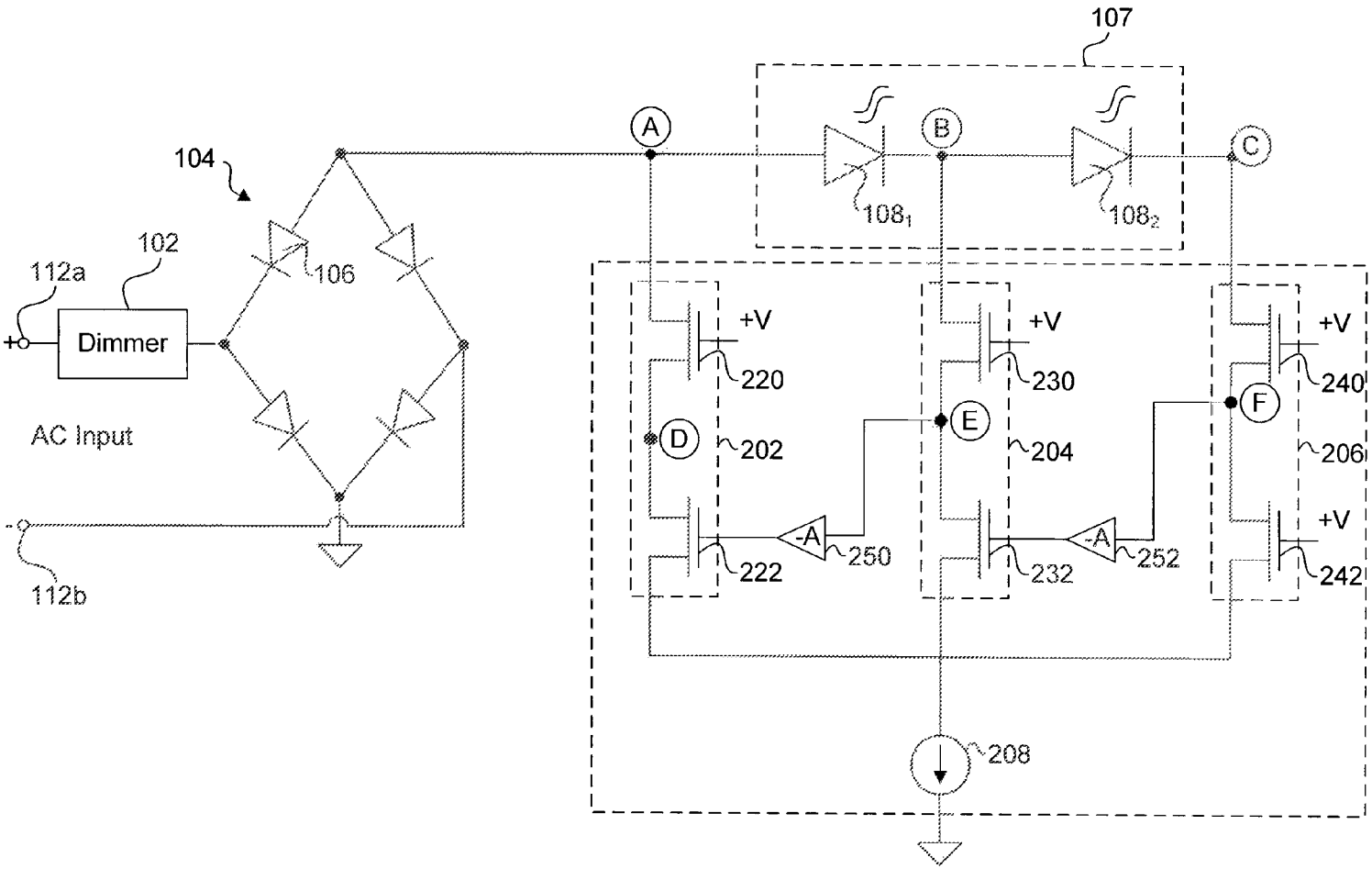
FIG. 2 is a schematic diagram of an exemplary light-emitting device.

FIG. 2 shows a schematic diagram of exemplary lighting device 100. Exemplary, current steering module 110 includes a holding current block 202, an intermediate current steering block 204, a final current steering block 206, and a current source 208.

Holding path block 202 includes FETs 220 and 222; intermediate current steering block 204 includes FETs 230 and 232; and final current steering path 206 includes FETs 240 and 242. In one embodiment, FETs 220, 222, 230, 232, 240, and 242 can be of the same conductivity type. For example, FETs 220, 222, 230, 232, 240, and 242 can be NFETs.

Still referring to FIG. 2, adjacent blocks of current steering module 110 are coupled using an amplifier having a gain of −A, e.g., inverting amplifiers. For example, holding current block 202 and intermediate current steering block 204 are coupled with an amplifier 250 and final intermediate current steering block 206 and intermediate current steering block 204 are coupled with an amplifier 252. An exemplary implementation of amplifiers 250 and/or 252 is described below with respect to FIG. 4.

Those skilled in the art will recognize that string 107 is not limited to any particular number of light-emitting devices. String 107 is shown to include two LEDs $\mathbf{108}_1$ and $\mathbf{108}_2$ for simplicity only. For example, in embodiments in which string 107 includes more than two LEDs, current steering module 107 can include an additional intermediate current steering block 204 for each additional LED. Intermediate current steering blocks 204 would be coupled using an amplifier having a negative gain in a manner similar to that shown in FIG. 2. The operation of lighting device 100 will be described in detail with respect to the flowchart of FIG. 3 and the plot of FIG. 5.

Figure 3:
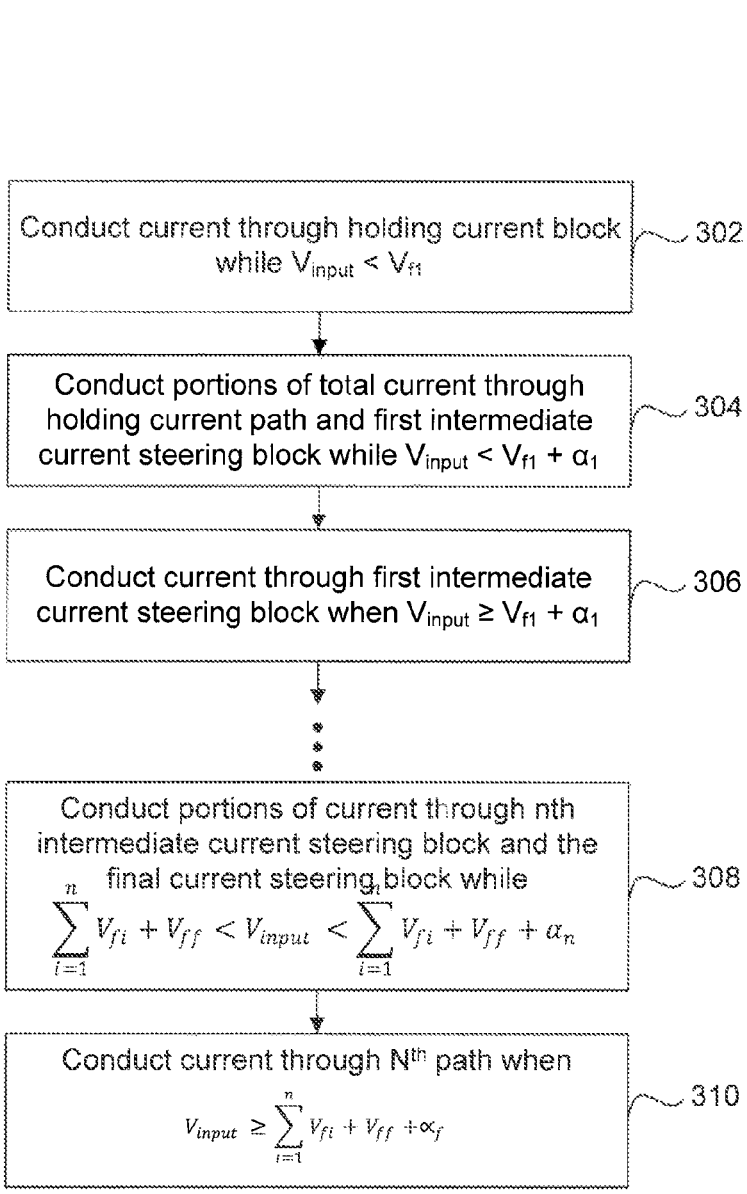
FIG. 3 is a flow diagram of an exemplary method of operating a light-emitting device.

FIG. 3 shows a flowchart of an illustrative method 300 of operating a light-emitting device. Other structural and operational embodiments will be apparent to persons skilled in the relevant art(s) based on the following discussion. The steps shown in FIG. 3 do not necessarily have to occur in the order shown. The steps of FIG. 3 are described in detail below.

In a step 302, current is conducted through a holding current block while an input voltage is less than a first forward voltage $V_{f1}$. For example, in FIG. 2, when the rectified input voltage is less than the forward voltage of LED $\mathbf{108}_1$, no current passes between nodes (A) and (B). Because the gate-to-source voltage of NFET 220 is held to a positive voltage V greater that its threshold voltage, NFET 220 is in a conducting, or "on" state. Moreover, because no current travels between nodes (A) and (B), no current travels between nodes (B) and (C), thus the voltage at node (E) (as well as the voltage at nodes (C) and (F)) is 0V. Thus, the input to amplifier 250 is 0V causing it to output a positive voltage. Thus, the gate-to-source voltage applied to NFET 222 is a positive voltage greater than its threshold voltage, which turns it on. Both of NFETS 220 and 222 being on, holding current block 202 passes all of the current between node A and current source 208.

In a step 304, portions of the total current are conducted through the holding current block and a first intermediate current steering block while the input voltage is less than the first forward voltage $V_{f1}$ and a constant $\alpha_1$. For example, in the illustrative embodiment of FIG. 2, when the rectified input voltage rises above the forward voltage of LED $\mathbf{108}_1$, current will start to pass through. LED $\mathbf{108}_1$ between nodes (A) and (B). Thus, node (E) will have a positive voltage because NFET 230 is already turned on. Since the input voltage is not high enough to turn LED $\mathbf{108}_2$ on, nodes (C) and (F) will remain at 0V. According to ideal operation, the presence of a positive voltage at node (E) would result in amplifier 250 outputting 0V, thereby disabling holding current block 202. However, because of the non-ideal operation of amplifier 250, an additional input voltage $\alpha_1$ is need to generate a sufficient voltage at node (E) such that the output of amplifier 250 is 0V. Until the input voltage reaches this value, holding current block 202 and intermediate current steering block 204 will pass portions of the total current required by current source 208. The proportion of the current passed by intermediate current steering block 204 rises as the rectified input voltage rises. As will be described in greater detail below, the particular value of $\alpha_1$ can be based on the values of resistors used to implement amplifier 250 as well as the open loop gain of the operational amplifier used to implement amplifier 250 and the reference voltage input to the op amp.

In a step 306, the total current is conducted through the first intermediate current steering block when the input voltage is greater than the sum of the first forward voltage and α1. For example, in the illustrative embodiment of FIG. 2, once the input voltage rises above $V_{f1}+\alpha_1$, the voltage at node (E) is sufficient to generate a zero or ground at the output of amplifier 250. Thus, NFET 222 is turned "off," i.e., non-conducting, and all of the current required by current source 208 passes through intermediate current steering block 204.

As shown in illustrative method of FIG. 3, this pattern of one block conducting a portion of the total current until the input voltage is sufficient such that the block's respective amplifier completely disables the preceding block continues as the input voltage rises. Thus, in a step 308 current is conducted through nth intermediate current steering block and the final current steering block, when $$\Sigma_{i=1}^{n} V_{fi}+V_{ff} \leq V_{input} < \Sigma_{i=1}^{n} V_{fi}+V_{ff}+\propto_{f}, \text{ where:}$$

$\Sigma_{i=1}^{n} V_{fi}$ is the sum of the forward voltages of the first n LEDs of the LED string;

$\propto_{f}$ is the constant voltage associated with final current steering block's respective amplifier; and $V_{ff}$ is the forward voltage of the final LED of the string.

For example, in FIG. 2, for simplicity sake only two LEDs are shown in LED string 107, thus n (i.e., the number of intermediate current steering blocks) is one. Thus, current passes through both intermediate current steering block 204 and final current steering block 206 while the input voltage is between the sum of the forward voltage of LEDs $\mathbf{108}_1$ and $\mathbf{108}_2$ and the sum of the forward voltages of LEDs $\mathbf{108}_1$ and $\mathbf{108}_2$ and $\alpha_2$, i.e., the constant associated with amplifier 252.

In a step 310, the total current passes through the final current steering block when:

$$V_{input} \geq \Sigma_{i=1}^{n} V_{fi}+V_{ff}+\propto_{f}$$

For example, in FIG. 2, when the input voltage is greater than the sum of the forward voltages of LEDs $\mathbf{108}_1$ and $\mathbf{108}_2$ and $\alpha_2$, all of the current provided by current source 208 is conducted through final current steering block 206.

Figure 4:
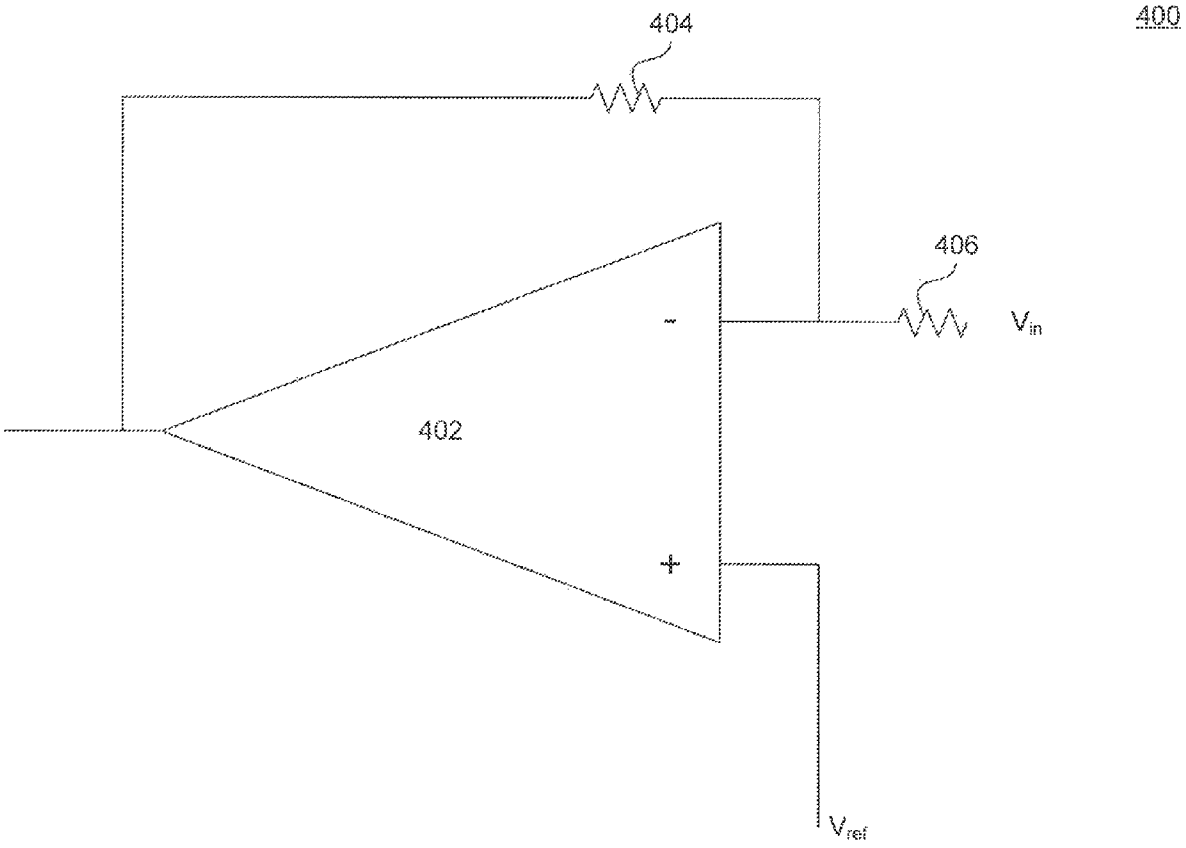
FIG. 4 is a schematic diagram of an exemplary amplifier.

FIG. 4 shows a schematic diagram of an exemplary amplifier 400. Amplifier 400 includes an op amp 402 and resistors 404 and 406. As shown in FIG. 4, op amp 402 is in an inverting amplifier configuration with resistor 404 coupling the negative terminal of op amp 402 to the output of op amp 402. In this configuration, amplifier 400 can deliver a gain of −A. The value of A can be a function of the open-loop gain of op amp 402 and the resistances of resistors 404 and 406.

As described above, amplifier 250 and/or amplifier 252 can be implemented as amplifier 400. In such an embodiment, the input voltage to amplifier 400 (shown in FIG. 4 as Vin) would be the supplied by the respective current steering block (e.g., an intermediate current steering block 204 or final current steering block 206). Being in an inverting configuration, when the input voltage is positive, amplifier 400 will output a voltage close to 0V. If the input voltage is close to 0V, amplifier 400 will output a positive voltage. The input voltage required for amplifier 400 to output 0V can be determined based on the open loop gain of op amp 402, the value of the reference voltage input to the positive terminal of op amp 402, and the values of resistors 494 and 406.

Figure 6:
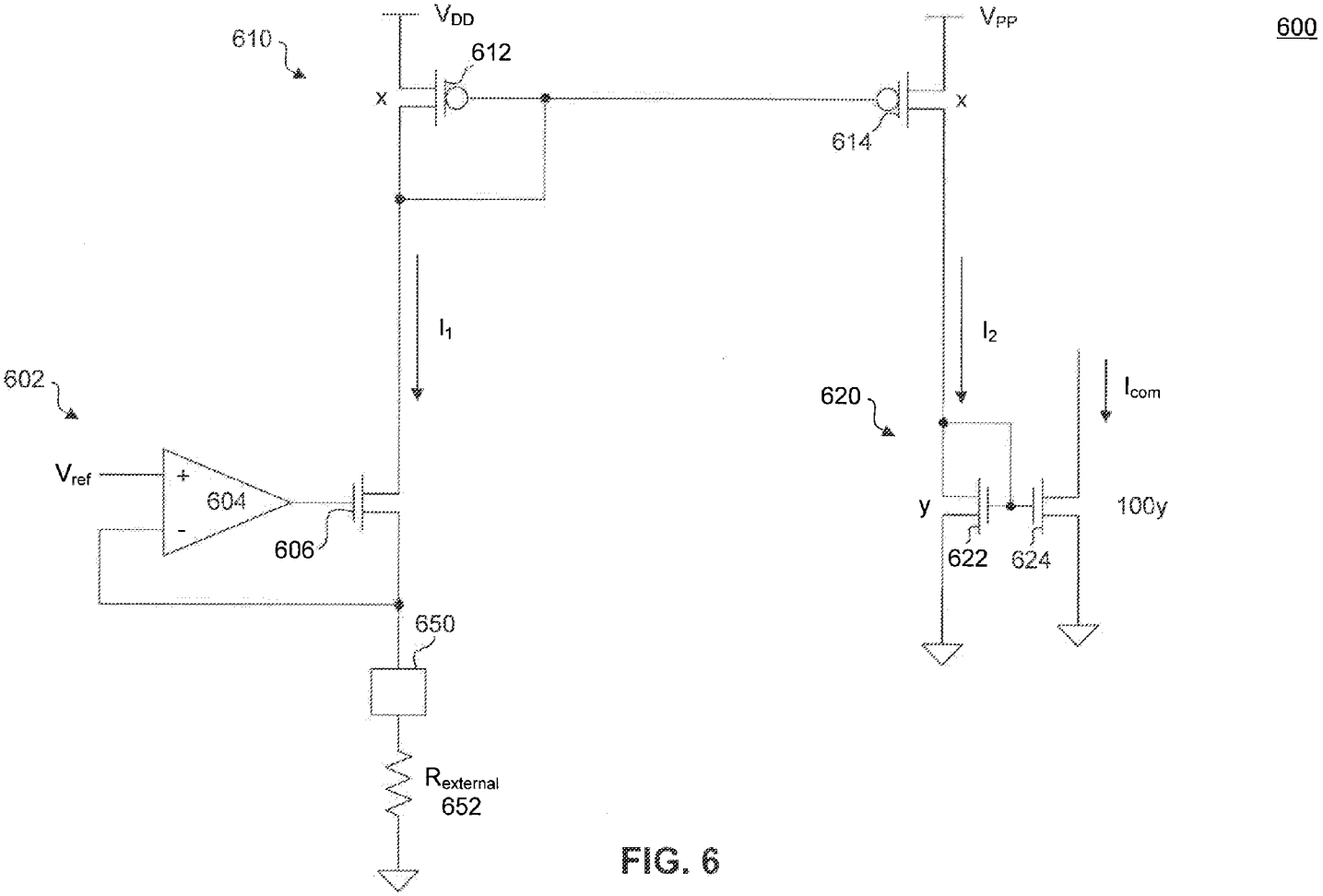
FIG. 6 is a schematic diagram of an exemplary current source.

FIG. 6 shows a schematic diagram of an exemplary current source 600. Current source 600 includes an current setting module 602 and first and second current mirrors 610 and 620. In an embodiment, current source 208, shown in the embodiment of the FIG. 2, can be implemented as current source 600.

Current setting module 602 includes an op amp 604 and an NFET 606. Op amp 604 is configured such that the voltage at the source of NFET 606 follows the reference voltage $V_{ref}$. Thus, when $V_{ref}$ is a constant voltage, the voltage at the source of NFET 606 can be held at a constant voltage. In an embodiment, the reference voltage $V_{ref}$ can be approximately 2.5V.

Current setting module 602 is coupled to a terminal 650, which itself is coupled to a resistor 652. Resistor 652 is typically, but not required to be, disposed externally to an integrated circuit on which current setting module 602 is implemented. In an embodiment, the choice of the resistance of resistor 652 can determine the input current for current source 600. For example, because the voltage at the source of NFET 606 is held to a constant value, the resistance of resistor 652 can determine the current that passes through resistor 652, which in turn sets the input current to current source 600. For example, in the embodiment in which $V_{ref}$=2.5V, if resistor 652 has a resistance of 2.5 kΩ, the input current $I_1$ is then set to 1 mA. More generally, the input current to current source 600 can be determined, using Ohm's law, as $$I_{input} = \frac{V_{ref}}{R_{external}}.$$

Current mirror 610 includes PFETs 612 and 614. PFETs 612 and 614 are provided in a mirroring configuration such that current $I_1$ that passes through PFET 612 (set by current setting module 602 and resistor 652) determines current $I_2$ that passes through PFET 614. In an embodiment, current $I_2$ is a multiple of $I_1$. In a further embodiment, the particular value of $I_2$ depends on the ratio of the nominal channel widths of PFETs 612 and 614. In the embodiment shown in FIG. 6, PFETs 612 and 614 have substantially the same width (labeled as "x" in FIG. 6). Thus, current is approximately equal to current $I_1$. In alternative embodiments, however, the channel width of PFET 614 can be chosen such that current $I_2$ is a different multiple of current $I_1$.

Current $I_2$ is received by current mirror 620. Current mirror 620 includes NFETs 622 and 624. NFETs 622 and 624 are coupled in a mirroring configuration such that the current that passes through NFET 624 is dependent on the current that passes through NFET 622 (i.e., current $I_2$) and the ratio of the channel widths of NFETs 622 and 624. In the embodiment of FIG. 6, NFET 624 has a channel width that is nominally 100 times larger than that of NFET 622. Thus, the current that passes through NFET 624, i.e., $I_{COM}$, is approximately 100 times larger than current $I_2$. For example, in the embodiment in which resistor 652 is chosen such that current $I_1$ is 1 mA, $I_{COM}$ would be 100 mA.

In an embodiment, resistor 652 can be a variable resistor, or potentiometer. As would be appreciated by those skilled in the art based on the description herein, the brightness of LEDs depends on the magnitude of the current passing through them. Thus, through the use of an external potentiometer (which controls the input current to current source 600), a user can control the brightness of the LEDs.

Figure 7:
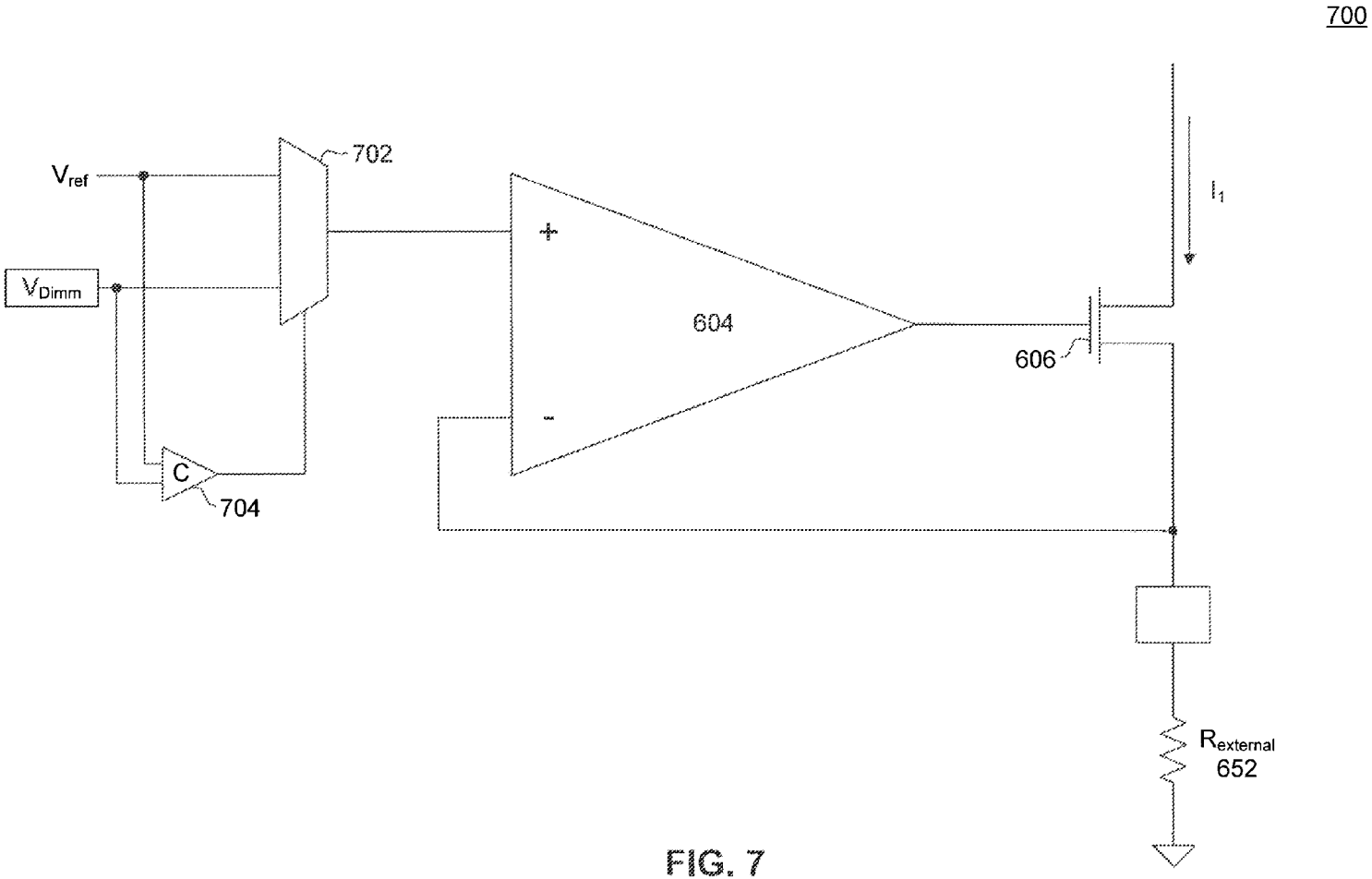
FIG. 7 is a schematic diagram of an exemplary current setting module.

FIG. 7 shows a schematic diagram of an exemplary current setting module 700. Current setting module 700 is substantially similar to current setting module 602, described with reference to FIG. 6, except that current setting module 700 additionally includes a multiplexer 702 and a comparator 704. In an embodiment, multiplexer 702 and comparator 704 can be configured such that the magnitude of current $I_1$ is controllable based on the voltage signal $V_{dimm}$. For example, comparator 704 receives voltage signals $V_{ref}$ and $V_{dimm}$ and outputs a control signal to multiplexer 702 which controls multiplexer 702 to output the minimum of $V_{ref}$ and $V_{dimm}$.

Still referring to FIG. 7, op amp 604 is configured such that its positive input terminal is coupled to the output of multiplexer 702, its negative input terminal is coupled to the source terminal of NFET 606 (which is also coupled to terminal 650), and its output terminal is coupled to the gate terminal of NFET 606. This feedback arrangement controls the output of op amp 604 such that its output voltage increases when the voltage at the source terminal of NFET 606 drops below the output of multiplexer 702. Since op amp 604 controls the gate drive of NFET 606, the increased voltage output from op amp 604 increases the magnitude of the current $I_1$ flowing drain-to-source through NFET 606. Increasing $I_1$ also increases the voltage the source terminal of NFET 606 ($I_1$ times $R_{external}$). In this way the resistance of resistor 652 can be used set the magnitude of the current $I_1$.

Current setting module 700 thus provides another way (in addition to the use of a potentiometer, as described above) that a user can vary the brightness of one or more LEDs. For example, the user can provide a variable $V_{dimm}$, and thereby control the change of brightness of the LEDs over time.

Figure 8:
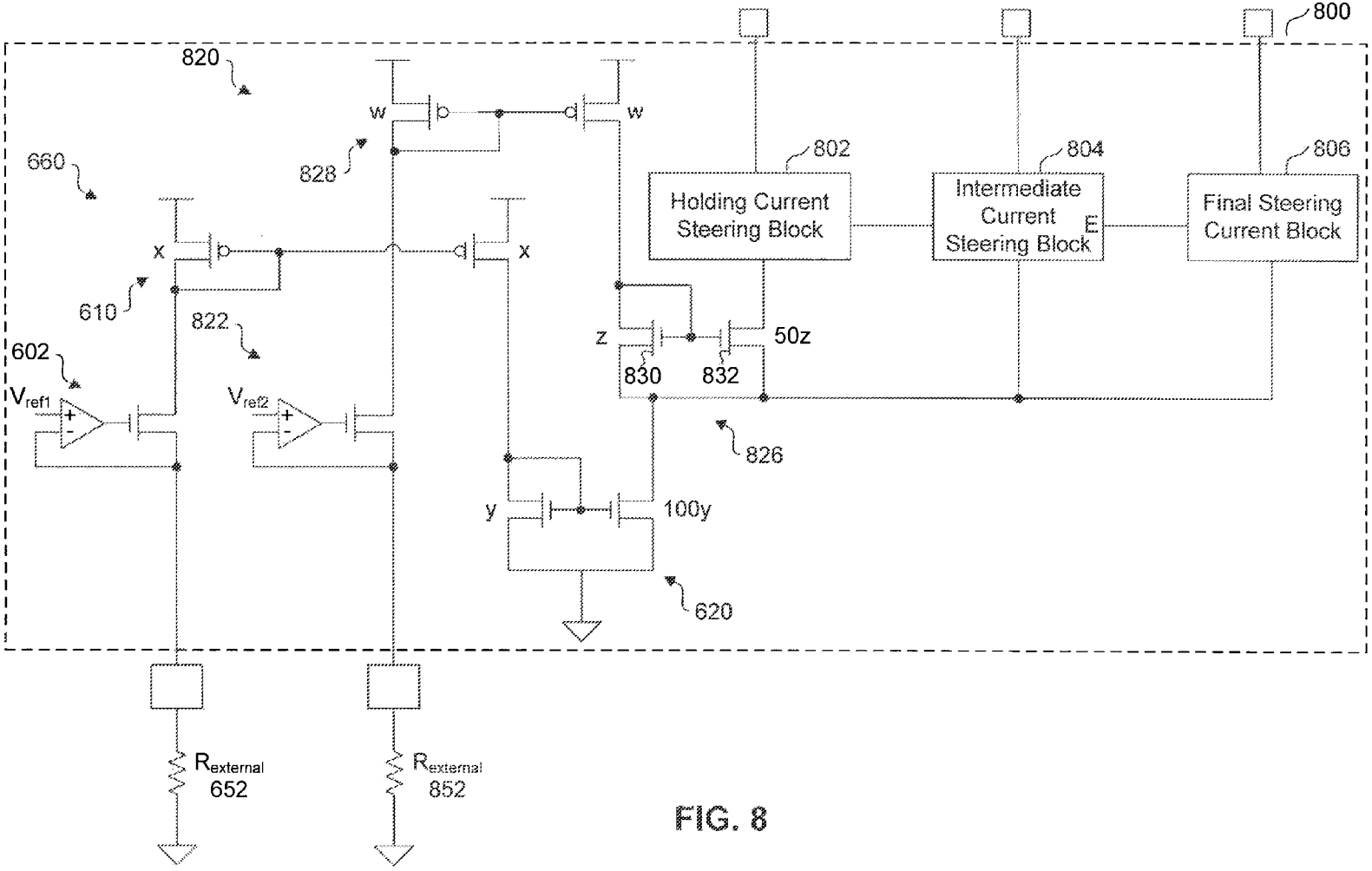
FIG. 8 is a schematic diagram of an exemplary current steering module.

FIG. 8 is a schematic diagram of an exemplary current steering module 800. Current steering module 800 includes a holding current steering block 802, an intermediate current steering block 804, a final current steering block 806, current source 660, and a current source 820. In an embodiment, holding current steering block 802, intermediate current steering block 804, and final current steering block 806 can be implemented as blocks 202, 204, and 206, respectively, each of which is described above with respect to the embodiment of FIG. 2.

Current steering module 800 can include additional intermediate current steering blocks 804. For example, in an embodiment in which a current steering module is to be used with a string of light-emitting devices that includes more than two light-emitting devices, current steering module 800 can include an additional intermediate current steering block 804 for each additional device in the string.

As noted above, current steering module 800 includes two current sources: current source 660 (see FIG. 6) and current source 820. In an embodiment, the use of two current sources enables greater flexibility in the magnitude of the current provided by current steering module 800. For example, as noted above, although a TRIAC generally requires a holding current to ensure proper operation, the current can often be relatively small. Thus, if the same current that is sized for one or more LEDs of an LED string is provided as the holding current, there may be a substantial waste of power. By including a second current source that is used to provide specifically the holding current, this wasted power can be reduced or eliminated. For example, as described below, current source 800, can be configured to provide half of the holding current that current source 600 would provide.

Current source 800 is substantially similar to current source 600. For example, current source 800 includes a current setting module 822 that is substantially similar to current setting module 602 and a current mirror 820 that is substantially similar to current mirror 610. However, current mirror 826 differs from current mirror 620 in that the channel width of NFET 832 is nominally 50 times, instead of 100 times, larger than the nominal channel width of NFET 830. Thus, in the embodiment in which the reference voltages input to current sources 600 and 800 (termed $V_{ref1}$ and $V_{ref2}$, respectively in FIG. 8) are the same and the resistances of external resistors 652 and 852 are the same, the holding current is half of the current that is supplied when either of intermediate current steering block 804 or final current steering block 806 are active. Thus, the power that would otherwise be wasted with an oversized holding current can be saved through the use of a second current source.

In one illustrative embodiment, a lamp control circuit, includes an intermediate current steering block configured to be coupled to a cathode of a first light-emitting device of a plurality of light-emitting devices; and a final current steering block configured to be coupled to a cathode of a final light-emitting device of the plurality of light-emitting devices, wherein the final current steering block is configured to disable the intermediate current steering block and conduct current when a voltage input to the plurality of light-emitting devices is sufficient to activate all of the plurality of light-emitting devices.

It will be appreciated that various alternative or additional functions can be incorporated with the circuitry of the present invention. In one illustrative alternative embodiment, wireless communication circuitry (e.g., Bluetooth, Wi-Fi) is included with the semiconductor-based light control circuitry of the present invention such that commands may be received from a remote controller. In this way, a semiconductor-based light may be installed in a conventional incandescent light socket and still provide dimming functionality without having to physically install dimmer switches in the wall. This may be particularly useful for consumers who desire the dimming function but are prohibited from making physical wiring changes by rental or lease agreements.

It will be further appreciated that various logical functions described herein may be implemented in any suitable manner, including but not limited to, hardware, software, or combinations thereof. Further various functions may be implemented with specific hardware, or by generalized hardware which is responsive to stored instructions (e.g., a microcontroller).

CONCLUSION

It is to be appreciated that the Detailed Description section, and not the Abstract of the Disclosure, is intended to be used to interpret the claims. The Abstract of the Disclosure may set forth one or more, but not all, exemplary embodiments of the invention, and thus, is not intended to limit the invention and the subjoined claims in any way.

It will be apparent to those skilled in the relevant art(s) that various changes in form and detail can be made therein without departing from the spirit and scope of the invention. Thus the invention should not be limited by any of the above-described exemplary embodiments, but should be defined only in accordance with the subjoined claims and their equivalents.

What is claimed is:

1. A lamp control circuit, comprising:

an intermediate current steering block configured to be coupled to a cathode of a first light-emitting device of a plurality of light-emitting devices;

a final current steering block configured to be coupled to a cathode of a final light-emitting device of the plurality of light-emitting devices, wherein the final current steering block is configured to disable the intermediate current steering block and conduct current when a voltage input to the plurality of light-emitting devices is sufficient to activate all of the plurality of light-emitting devices; and a current source coupled to the intermediate current steering block, and further coupled to the final current steering block.

2. The lamp control circuit of claim 1, wherein at least one of the plurality of light-emitting devices is a light emitting diode (LED).

3. The lamp control circuit of claim 1, wherein at least one of the plurality of light-emitting devices is an organic light emitting diode (OLED).

4. The lamp control circuit of claim 1, wherein the intermediate current steering block comprises:

a first NFET coupled drain-to-source between a cathode of a first one of the plurality of light-emitting devices, and a first intermediate node; and a second NFET coupled drain-to-source between the first intermediate node and the current source.

5. The lamp control circuit of claim 1, wherein the final current steering block comprises:

a third NFET coupled drain-to-source between a cathode of a second one of the plurality of light-emitting devices, and a second intermediate node; and a fourth NFET coupled drain-to-source between the second intermediate node and the current source.

6. The lamp control circuit of claim 5, wherein the third NFET has a gate electrode coupled to a positive voltage source; and the fourth NFET has a gate electrode coupled to the positive voltage source.

7. The lamp control circuit of claim 6, wherein the first NFET has a gate electrode coupled to the positive voltage source; and the second NFET has a gate electrode coupled to an output terminal of a first inverting amplifier.

8. The lamp control circuit of claim 7, wherein the first inverting amplifier has an input terminal coupled to second intermediate node.

9. The lamp control circuit of claim 8, further comprising:

a second inverting amplifier;

wherein the second inverting amplifier has an input terminal coupled to the first intermediate node.

10. The lamp control circuit of claim 9, further comprising:

a holding path block coupled between the output of a full-wave rectifier and the current source.

* * * * *